US005547315A

United States Patent [19]

Halloran, Jr.

[11] Patent Number: 5,547,315

[45] Date of Patent: Aug. 20, 1996

[54] POST ANCHOR

[76] Inventor: Charles F. Halloran, Jr., 1607 Bailey Ave., Chattanooga, Tenn. 37404

[21] Appl. No.: 272,131

[22] Filed: Jul. 8, 1994

[51] Int. Cl.[6] ..... E02D 5/80; E02D 5/54

[52] U.S. Cl. ..... 405/244; 52/154; 248/545; 405/232

[58] Field of Search ..... 405/244, 232, 405/231; 248/545, 156; 52/293, 298, 154

[56] References Cited

U.S. PATENT DOCUMENTS

| | | | |
|---|---|---|---|
| 2,947,149 | 8/1960 | Barkley | 405/244 |
| 4,896,651 | 1/1990 | Kott | 248/545 X |
| 5,104,265 | 4/1992 | Halloran | 405/244 |
| 5,396,743 | 3/1995 | Bellette | 52/154 |

FOREIGN PATENT DOCUMENTS

| | | | |
|---|---|---|---|
| 2614059 | 10/1988 | France | 248/545 |

*Primary Examiner*—Dennis L. Taylor
*Attorney, Agent, or Firm*—Alan Ruderman

[57] ABSTRACT

A socket for receiving a post, column or rod has a closed end forming a seat against which the post, column or rod may be seated when installed, the socket being secured within the ground or other solid body which may be entered when pierced. The socket is a unitary member which, in one form, may be a sheet of metal folded to have an internal cross sectional configuration corresponding to the post, column or rod and has folds which form the closed end, portions of the folds converging to an oblique leading edge which may pierce and penetrate the ground or other solid body. In an other form of the invention the socket is a hollow tube swaged closed at one end and may be ground to an oblique edge.

11 Claims, 1 Drawing Sheet

POST ANCHOR

BACKGROUND OF THE INVENTION

This invention relates to the installation of posts, columns or rods into the ground or other solid body having a structure wherein components thereof may be dispersed, spread or diffused when penetrated to permit entry, and more particularly to a socket or sleeve for installation into such solid bodies for receiving a post, column or rod.

In U.S. Pat. No. 5,104,265, which has a common inventorship as the present invention, there is disclosed a socket for receiving a channel shaped sign post and a method for driving the socket into the ground, the sign post being thereafter inserted into the socket. The socket there disclosed is a hollow channel shaped member of the same cross section as the sign post and includes a rigid leader for closing the bottom end of the socket. A portion of the leader is disposed within the socket and a portion is disposed outside the socket. The socket is driven into the ground by positioning an elongated drive rod into the socket with the lower end of the drive rod in abutment with the upper end of the leader and thereafter impacting the upper end of the drive rod from outside the socket while maintaining the lower end in abutment with the upper end of the leader. Since the top of the socket is not impacted, it is not deformed and all of the driving force is applied to the bottom of the socket by the action of the leader.

In certain applications, such as where the posts or columns to be installed do not have to carry large signs or the like, the post or columns are relatively light in weight and may be relatively short such as those which carry reflectors or a small sign or placard. Such posts or columns thus do not require intricate channel shaped configurations and may merely be of a rectangular form or a circular rod form. Accordingly, sockets and anchors for the installation of such posts, columns or rods may be of a less intricate construction. Desirably such sockets or anchors may be of a less costly construction than the socket disclosed in the aforesaid patent, yet be equally effective when used with these posts, columns or rods.

SUMMARY OF THE INVENTION

Consequently, it is a primary object of the present invention to provide an anchor or socket adapted to be driven into the ground or other solid body permitting entry when penetrated for receiving a post, column or rod.

It is another object of the present invention to provide an anchor or socket comprising a unitary member having an open end for receiving a post, column or rod to be installed in the ground or other solid body permitting entry when penetrated for receiving a post, column or rod, and having a closed end adapted to be impacted by an installing drive rod acting on the closed end.

It is a further object of the present invention to provide an anchor or socket formed from a sheet of metal and having an open end and a folded closed end, the anchor or socket adapted to receive an impacting rod in abutment with the closed end for driving the anchor or socket into the ground for receiving a post or column.

It is a still further object of the present invention to provide an anchor or socket formed from tubing having a closed end including a chisel point, the anchor or socket being adapted to receive an impacting rod abutting the closed end so that the anchor or socket may be impacted at the closed end and driven into a solid body for thereafter receiving a post, column or rod.

Accordingly, the present invention provides an anchor or socket for receiving a post, column or rod, the anchor or socket having a hollow cavity conforming to the shape of the post, column or rod to be received therein, the anchor or socket having a closed end forming a seat against which the post, column or rod may be seated when installed, the seat being impacted by a driving rod for driving the anchor or socket into the ground or other solid body comprising spreadable components permitting entry when penetrated by the anchor or socket. The anchor or socket is formed from a unitary member which may, in one form of the invention, be a sheet of metal formed into the cross sectional configuration of the post, column or rod to be installed and folded at the closed end so as to have portions thereof converge to an oblique edge for piercing and penetrating the ground. Preferably a portion of the lower end of the anchor or socket has portions thereof removed for permitting the remaining portions of the end to be folded readily. Longitudinal edges of the sheet may overlap or join loosely at a juncture. In another form of the invention the anchor or socket may be a hollow tube swaged closed at one end and ground to an oblique sharpened edge.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENTS

Figure 1:
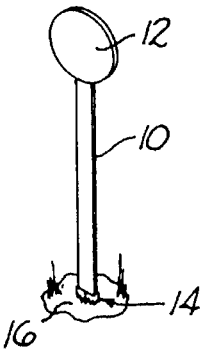
FIG. 1 is a perspective view of a sign having a substantially rectangular shaped post installed within a socket or anchor constructed and positioned within the ground in accordance with the principles of the present invention.
Figure 2:
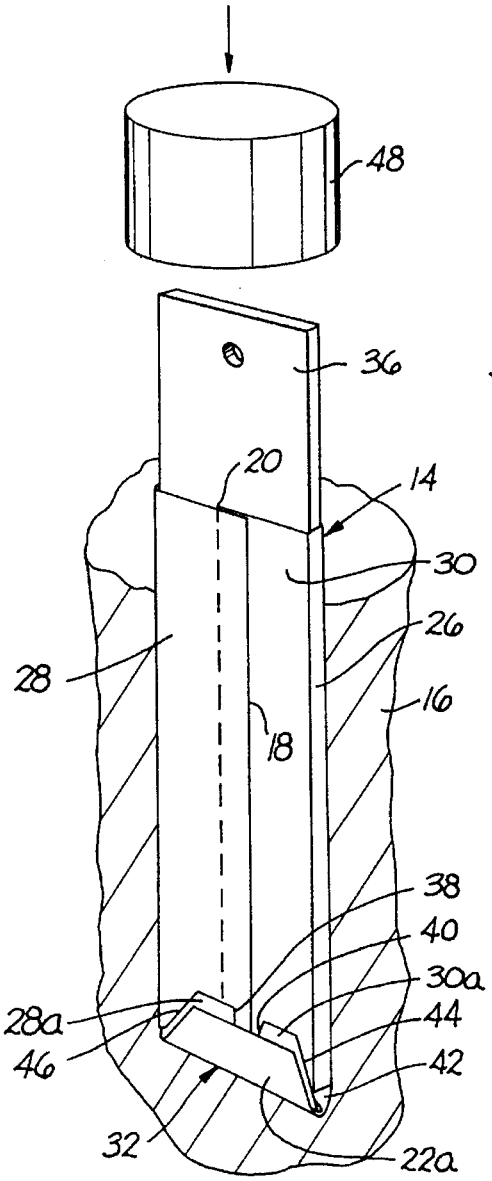
FIG. 2 is a perspective view illustrating the method of installing the socket or anchor within the ground.

Referring now to the drawings, a post or column 10, which may mount a sign, placard, reflector or the like 12 at its upper end, is secured within an anchor or socket 14 constructed in accordance with the present invention and entrapped within the ground 16. The post or column 10 may be a solid or a hollow body and may have a rectangular cross sectional configuration as is common for posts which do not carry heavy signs, a post having a channel cross sectional configuration as described in the aforesaid U.S. Patent, not being necessary in that case. The anchor or socket 14 has an internal cross sectional configuration substantially identical to the external cross sectional configuration of the post 10 for slidably but snugly receiving same after the socket 14 has been installed in the ground.

Figure 3:
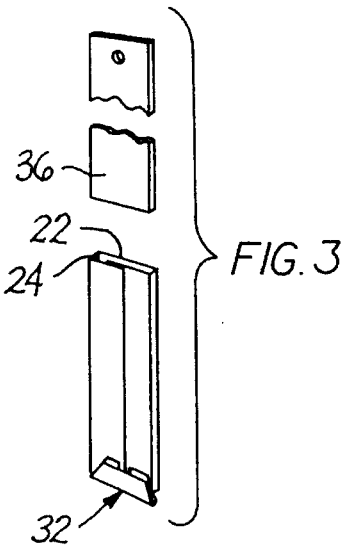
FIG. 3 is a perspective view illustrating the insertion of a driving rod into the socket or anchor in preparation for driving the socket or anchor into the ground with portions of the driving rod being broken away.

The socket 14 is metal and is preferably constructed from a sheet of galvanized steel, or, obviously, it may be an extrusion of aluminum. The sheet has a length such that when installed in the ground and the post or column is inserted into the socket the post will extend from the surface of the ground the desired height. The width of the sheet of metal is such that it may be bent or folded into the desired dimensions and shape for receiving the post as aforesaid. Thus, for an anchor having a rectangular configuration, the longitudinally extending side borders or edges 18, 20 of the sheet when bent or folded to have a back wall 22, as illustrated in FIG. 3, and sides 24, 26, are at the ends of panels 28, 30 which form the front of the anchor. The edges 18, 20 may overlap slightly such that one of the panels, e.g. panel 28 is slightly in front of the other panel by an amount substantially equal to the thickness of the sheet metal, or the edges 18, 20 may be disposed along a common longitudinal line. In either case it may be desirable to apply a strip of tape (not illustrated) along the outer edge 18 or along the common edges 18, 20 to prevent slivers of metal from endangering a person handling the socket.

In order to close the bottom end 32 of the socket so as to form a leading edge 34 which may penetrate the ground when impacted and to simultaneously form a seat for an impacting rod 36, the lower end of the back wall 22 and the front wall comprising the panels 28, 30, are bent, folded or otherwise compressed one on the other so that one, preferably a bottom portion **22*a* of the back wall, is superposed onto the bottom portions 28*a*, 30*a* of the front panels which are superposed onto adjacent portions of the front panels 28, 30 above the bottom end as illustrated in the drawings. To aid in the bending and folding, the bottom portions of the front panels preferably are notched as illustrated at 38, 40, and the bottom of each side 24, 26 between the back wall 22 and the front wall panels 28, 30 is removed as illustrated at 42 to leave a bottom edge 43 in regard to side 26 so that the sides 24, 26 terminate above the leading edge 34. Portions of the back wall and front panels adjacent each side 24, 26 are also removed on a bias as illustrated generally at 44 and 46. Thus, when the fold or bend is made to the lower end of the back wall and the front panels the folded members 22*a*, 28*a*, 30*a* converge toward the thusly formed leading edge 34** of the socket.

Figure 4:
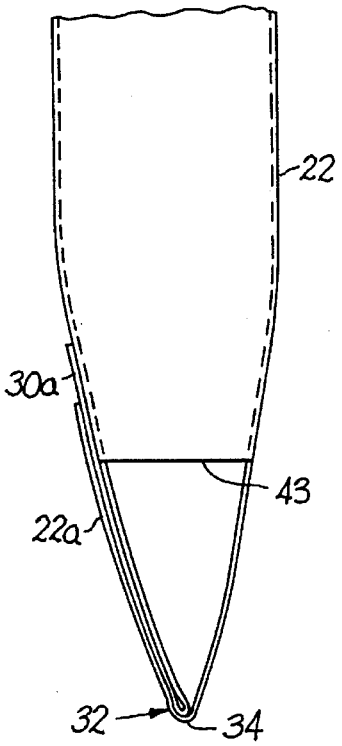
FIG. 4 is a side elevational view of the closed end of the socket or anchor illustrated in FIGS. 2 and 3.

As illustrated in FIG. 4 this provides a reasonably sharp edge for piercing and penetrating the ground. It also provides a tapered interior at the bottom of the socket. Alternatively, either the back wall 22 or the panels 28 and 30 may be cut away substantially at the elevation of the edge 43 so that only either the bottom portions **28*a* and 30*a* or the bottom portion 22*a* respectively remains to be bent to form the leading edge. In that case if the remainder is the portion 22*a*, it may be bent to abut the panels 28, 30, but if the remainder is the portions 28*a*, 30*a*, they may be bent in the opposite direction to abut the back wall 22. In any case it forms the leading edge 34** and a tapered interior at the bottom of the socket.

The impacting rod 36 thus may be inserted into the socket to abut the tapered interior surfaces of the back wall 22 and of the front panels 28, 30 adjacent the interior of the leading edge 32 which thereby forms the seat for the bottom of the impacting rod 36. The impacting rod is thereafter impacted by a hammer 48 or the like while maintained in abutment with the closed bottom interior surfaces of the socket as taught in the aforesaid patent. The folded portions of the closed end expand outwardly when impacted thereby to secure the socket firmly in the ground. After the socket is installed in the ground, the post or column 10 may be inserted and secured by conventional means preferably at the upper end of the socket.

Figure 5:
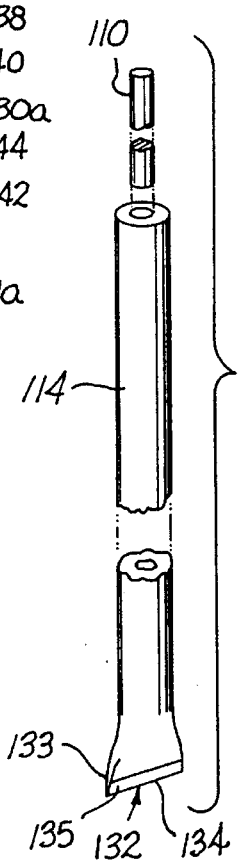
FIG. 5 is a perspective view similar to FIG. 3 but of a socket or anchor having a circular configuration for receiving a cylindrical rod.

In another form of the invention, as illustrated in FIG. 5, the socket may be of a cylindrical configuration preferably comprising a hollow tube 114 with the lower end 132 closed. Closing of the lower end of the tube may be by swaging or hammering so that the tubular wall at the bottom is crushed or crimped at 180 degree opposed wall portions and flares outwardly at approximately 90 degrees to the crushed portions as illustrated at 133 to form a leading edge 134. The leading edge 134 is thus longer than the outer diameter of the tube. Additionally, if desired, the bottom may be welded closed, and preferably may be ground adjacent the leading edge such as at 135 to form the leading edge into an oblique body piercing and penetrating chisel-like point.

The anchor illustrated in the embodiment of FIG. 5 may be used for cylindrical posts or may be used in conjunction with cylindrical rods for anchoring such rods 110 in a solid body permitting entry when pierced and penetrated such as wood. In any case, the anchor or socket 114 may be driven into the ground or such bodies by insertion of an impact rod having the same configuration as the post or rod 110 and thus the internal configuration of the tube 114 until it abuts and seats at the closed bottom end. Thereafter while maintained in abutment with the seat formed by the closed end the impact or driving rod is hammered into the ground or body as heretofore described and as described in the aforesaid U.S. Patent.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A socket for installing a post or the like in a solid body permitting entry when pierced, said post having a predetermined cross sectional configuration, said socket comprising a unitary member having wall means of finite length defining an elongated hollow cavity having a cross sectional configuration substantially identical to that of said post for receiving said post snugly, closure means solely comprising at least a portion of said wall means at one end of said unitary member for closing said one end of said cavity and forming a seat within said cavity for abutment by said post and for forming the exterior surface of said one end into an oblique configuration having a pair of discrete oppositely facing surfaces defining a leading edge for piercing and entering said body when said socket is impacted with said leading edge abutting said body, whereby said socket may be positioned within the body with a second end opposite said one end accessible for receiving said post and for abutting said seat.

2. A socket as recited in claim 1, wherein said unitary member comprises a sheet having longitudinally extending side edges extending from said one end to said second end, longitudinally extending portions of said sheet having folds for diverting adjacent portions of said sheet to form said wall means and for disposing said side edges adjacent one another, said closure means comprising at least a portion of said wall means adjacent said one end folded into superposed relationship with an exterior surface of another portion of said wall means to form said leading edge.

3. A socket as recited in claim 2, wherein portions of said sheet adjacent said side edges are folded into said superposed relationship with adjacent portions of said sheet adjacent said side edges.

4. A socket as recited in claim 3, wherein a portion of said wall means opposite said side edges is folded into superposed relationship with said portions adjacent said side edges.

5. A socket as recited in claim 2, wherein said socket has a rectangular cross sectional configuration comprising a planar wall defining a rear panel, a pair of spaced apart side panels each having a longitudinally extending fold along a junction with the rear panel, and a pair of front panels spaced from said rear panel and having a respective longitudinal fold at a junction with one of said side panels, each front panel including one said side edges.

6. A socket as recited in claim 5, wherein a portion of each front panel at said one end is folded into superposed relationship with adjacent portions of the corresponding front panel.

7. A socket as recited in claim 6, wherein a portion of each side panel at said one end spaced from said leading edge adjacent said portion of each front panel is removed.

8. A socket as recited in claim 6, wherein a portion of said rear panel at said one end is folded into superposed relationship with said front panels.

9. A socket as recited in claim 8, wherein a portion of each side panel at said one end spaced from said leading edge adjacent said portion of each of said front panels and said portion of said rear panel is removed.

10. A socket as recited in claim 1, comprising a tubular cylindrical configuration having an axis of elongation and an external diameter, and wherein said leading edge has a dimension transverse to said axis greater than said external diameter.

11. A socket as recited in claim 8, wherein said leading edge has a chisel shape configuration.

* * * * *